US008208832B2

(12) United States Patent
Yoshida et al.

(10) Patent No.: US 8,208,832 B2
(45) Date of Patent: Jun. 26, 2012

(54) TONER-COLLECTING DEVICE AND IMAGE FORMING APPARATUS

(75) Inventors: Tomofumi Yoshida, Ibaraki (JP); Hirobumi Ooyoshi, Ibaraki (JP); Kenzo Tatsumi, Osaka (JP); Yoshihiro Kawakami, Hyogo (JP); Yoshiyuki Shimizu, Osaka (JP); Tomohiro Kubota, Osaka (JP); Koji Kato, Ibaraki (JP)

(73) Assignee: Ricoh Company, Limited, Tokyo (JP)

( * ) Notice: Subject to any disclaimer, the term of this patent is extended or adjusted under 35 U.S.C. 154(b) by 1076 days.

(21) Appl. No.: 12/062,865

(22) Filed: Apr. 4, 2008

(65) Prior Publication Data

US 2008/0267661 A1 Oct. 30, 2008

(30) Foreign Application Priority Data

Apr. 25, 2007 (JP) ..... 2007-115329

(51) Int. Cl.
*G03G 15/08* (2006.01)

(52) U.S. Cl. ..... 399/120

(58) Field of Classification Search ..... 399/120
See application file for complete search history.

(56) References Cited

U.S. PATENT DOCUMENTS

| | | | | |
|---|---|---|---|---|
| 5,614,996 | A * | 3/1997 | Tanda | 399/120 |
| 6,085,062 | A | 7/2000 | Mizuishi et al. | |
| 2006/0067735 | A1 * | 3/2006 | Sanada et al. | 399/120 |
| 2007/0053722 | A1 * | 3/2007 | Sato et al. | 399/258 |
| 2007/0104523 | A1 | 5/2007 | Yoshida et al. | |
| 2007/0140763 | A1 | 6/2007 | Shimizu et al. | |
| 2007/0248390 | A1 | 10/2007 | Kubota et al. | |
| 2008/0152379 | A1 * | 6/2008 | Saiki et al. | 399/106 |

FOREIGN PATENT DOCUMENTS

| | | |
|---|---|---|
| JP | 9-281866 | 10/1997 |
| JP | 2002-132109 | 5/2002 |
| JP | 2004-184820 | 7/2004 |
| JP | 2006-98646 | 4/2006 |
| JP | 2006-98743 | 4/2006 |
| JP | 2006-276732 | 10/2006 |

OTHER PUBLICATIONS

Japanese Office Action issued Jul. 19, 2011, in Patent Application No. 2007-115329.

* cited by examiner

*Primary Examiner* — David Gray
*Assistant Examiner* — Andrew Do
(74) *Attorney, Agent, or Firm* — Oblon, Spivak, McClelland, Maier & Neustadt, L.L.P.

(57) ABSTRACT

A toner-collecting device includes a toner-collecting unit, a shaft member, and a guide member. The toner-collecting unit is configured to be detachably attachable. The shaft member is rotatably arranged in the toner-collecting unit. The guide member includes a sliding portion that allows the shaft member to slide while the shaft member is being inserted from one end to an opposite end of the toner-collecting unit.

18 Claims, 12 Drawing Sheets

TONER-COLLECTING DEVICE AND IMAGE FORMING APPARATUS

CROSS-REFERENCE TO RELATED APPLICATIONS

The present application claims priority to and incorporates by reference the entire contents of Japanese priority document 2007-115329 filed in Japan on Apr. 25, 2007.

BACKGROUND OF THE INVENTION

1. Field of the Invention

The present invention relates to a toner-collecting device and an image forming apparatus.

2. Description of the Related Art

Image forming apparatuses, such as copiers, printers, facsimile machines, and multifunction product (MFP) that combines any or all of the functions of these, include a process unit. In the process unit system, a casing that houses an image carrier (photosensitive drum), a charger, a developing unit, or a process unit such as a toner-collecting unit can be detachably attached to a main body of the image forming apparatus. By using the process unit system, a user can easily replace the process unit at the time of maintenance.

Japanese Patent Application Laid-open No. 2006-98743 discloses a conventional image forming apparatus that includes a process unit including an image carrier and a toner-collecting unit. The toner-collecting unit contains waste toner that remains after an image is created. Conveying screws for conveying waste toner are fixedly set inside the toner-collecting unit. Waste toner is brought in from an opening of the toner-collecting unit and stirred by the conveying screws. With this configuration, the toner-collecting unit can be effectively filled with waste toner.

An outer wall that forms the toner-collecting unit is formed of two segmented casings. Upon manufacture of the toner-collecting unit, matching surfaces of the casings are ultrasonically welded such that toner does not leak out from between the matching surfaces.

However, in the process of manufacturing the toner-collecting unit that internally includes the conveying screws as described above, if both the casings are welded after the conveying screws are inserted in the casings, end portions of the conveying screws protruding from the casings come in the way to hold the casings by using a welding horn. Accordingly, the conveying screws need to be inserted in the casings after the casings are welded.

Insertion of shaft members such as conveying screws from one end of the casings to the other end is difficult after the casings are welded. This decreases manufacturing efficiency.

SUMMARY OF THE INVENTION

It is an object of the present invention to at least partially solve the problems in the conventional technology.

According to an aspect of the present invention, there is provided a toner-collecting device including a toner-collecting unit that is configured to be detachably attachable; a shaft member that is rotatably arranged in the toner-collecting unit; and a guide member that includes a sliding portion that allows the shaft member to slide while the shaft member is being inserted in an insertion direction from one end to an opposite end of the toner-collecting unit through an insertion path.

According to another aspect of the present invention, there is provided an image forming apparatus that includes a toner-collecting device including a toner-collecting unit that is configured to be detachably attached to the image forming apparatus; a shaft member that is rotatably arranged in the toner-collecting unit; and a guide member that includes a sliding portion that allows the shaft member to slide while the shaft member is being inserted from one end to an opposite end of the toner-collecting unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
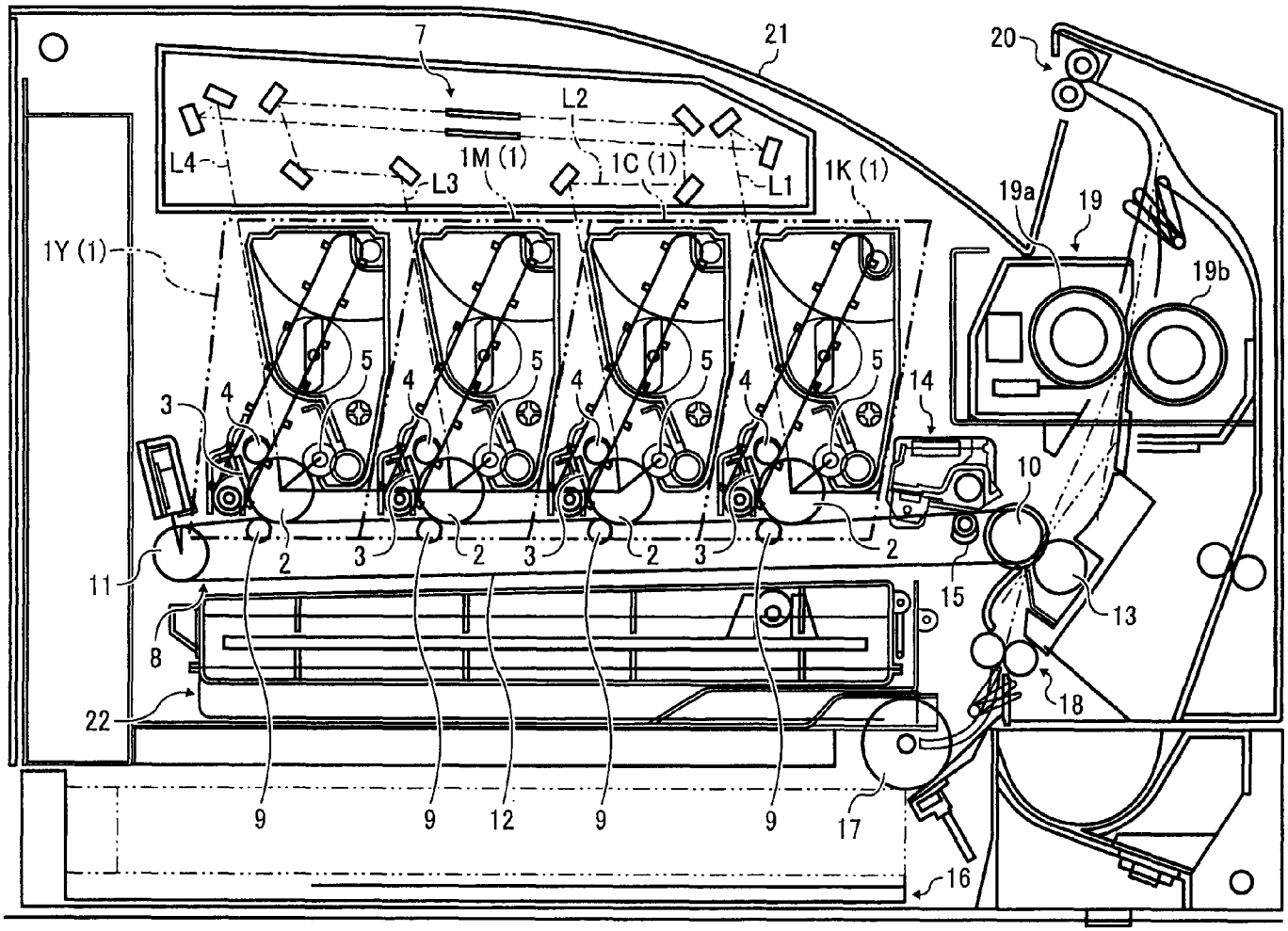
FIG. 1 is a schematic diagram of an image forming apparatus according to an embodiment of the present invention.

FIG. 1 is a schematic diagram of an image forming apparatus according to an embodiment of the present invention. The image forming apparatus is, for example, a color machine that includes process units 1K, 1C, 1M, and 1Y for forming an image by using developers of different colors: black (K), cyan (C), magenta (M), and yellow (Y), corresponding to color-difference components of a color image.

The process units 1K, 1C, 1M, and 1Y are of like configuration except for color of toner used therein and thus but one of them, for example, the process unit 1K is described in detail. The process unit 1K includes an image carrier 2, a charger 4, a developing unit 5, and a cleaner 3. The process unit 1K is detachably attached to the image forming apparatus so that worn-out components can be replaced at the same time.

An exposure device 7 is arranged on an upper side of the process units 1K, 1C, 1M, and 1Y. The exposure device 7 includes a light source such as a laser diode that emits laser beams L1 to L4 based on image data.

A transfer device 8 is arranged on a lower side of the process units 1K, 1C, 1M, and 1Y. The transfer device 8 includes four primary transfer rollers 9 facing image carriers 2, respectively, an intermediate transfer belt 12, a secondary transfer roller 13, a belt cleaning device 14, and a cleaning backup roller 15. The intermediate transfer belt 12 is wound around the primary transfer rollers 9, a driving roller 10, and a driven roller 11, and endlessly moves around them. The secondary transfer roller 13 is positioned on an opposite side of the driving roller 10.

At a lower portion of the image forming apparatus are arranged a feed cassette 16 capable of containing a stack of sheet-type recording mediums (sheets) and a feed roller 17 that transfers sheets from the feed cassette 16. A pair of registration rollers 18 temporarily stops a sheet and is arranged on a path from the feed roller 17 to a nip between the secondary transfer roller 13 and the driving roller 10.

A fixing device 19 is arranged on the upper side of the nip between the secondary transfer roller 13 and the driving roller 10. The fixing device 19 includes a fixing roller 19*a*, which internally includes a heat source (not shown) such as a halogen lamp, and a pressure roller 19*b*, which rotates while in contact with the fixing roller 19*a* at a predetermined pressure.

A pair of eject rollers 20 is arranged on the upper side of the fixing device 19 for ejecting sheets. Sheets ejected by the eject rollers 20 are stacked on a stacking tray 21 that forms a curved surface of a top cover.

A waste toner collecting device 22 is arranged between the transfer device 8 and the feed cassette 16 and contains waste toner removed by the belt cleaning device 14. A waste toner transport pipe (not shown), which extends from the belt cleaning device 14, is connected to an inlet port of the waste-toner collecting device 22.

Figure 2:
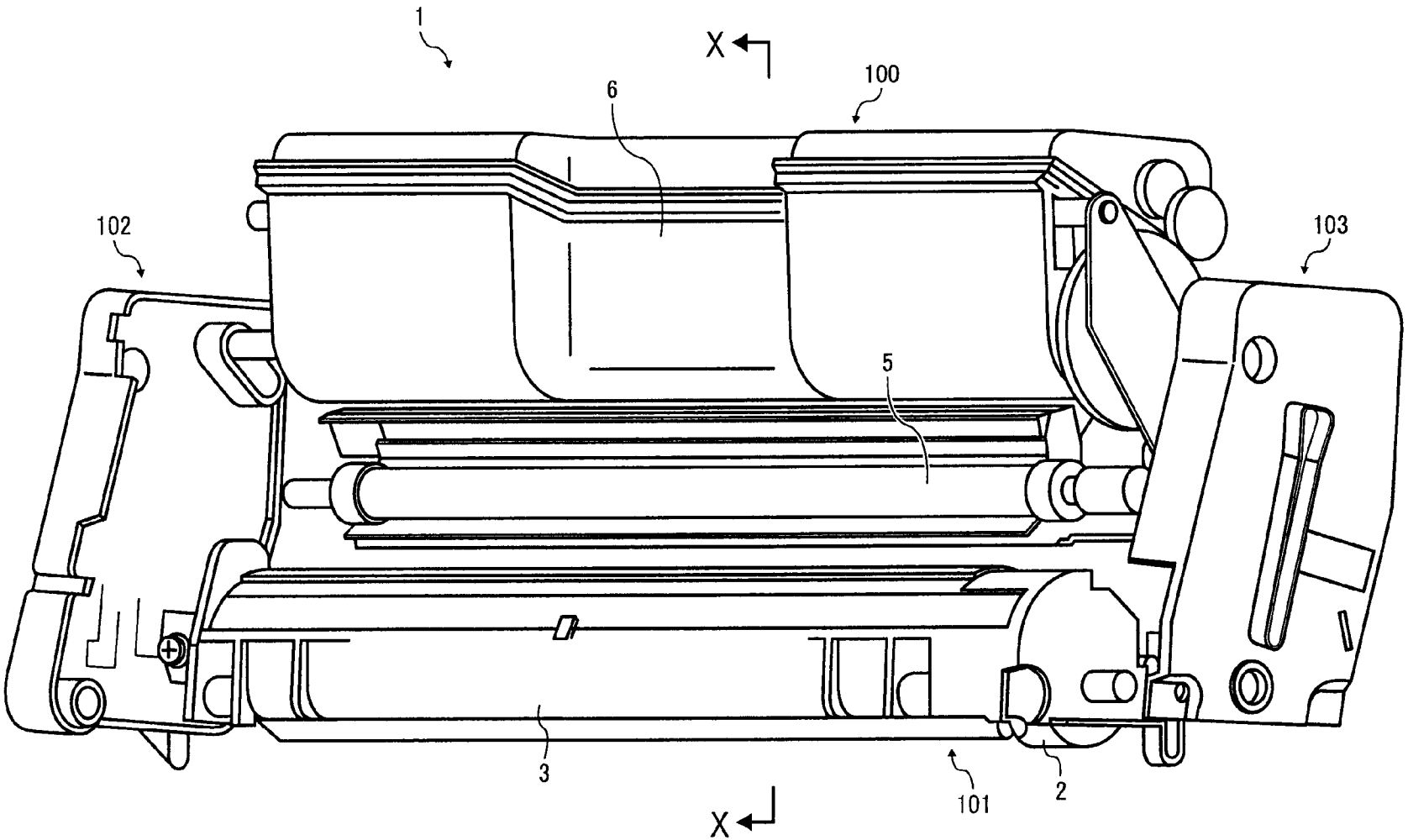
FIG. 2 is a perspective view of a process unit shown in FIG. 1.

The structure of the process unit 1 (1K, 1C, 1M, 1Y) is explained in detail below. FIG. 2 is a perspective view of the process unit 1. The process unit 1 includes a developer 100 that includes the developing unit 5 and a toner-collecting unit 6, an image carrier unit 101 that includes the image carrier 2 and the cleaner 3, a first supporting member 102 and a second supporting member 103 that support the developer 100 and the image carrier unit 101.

Figure 3:
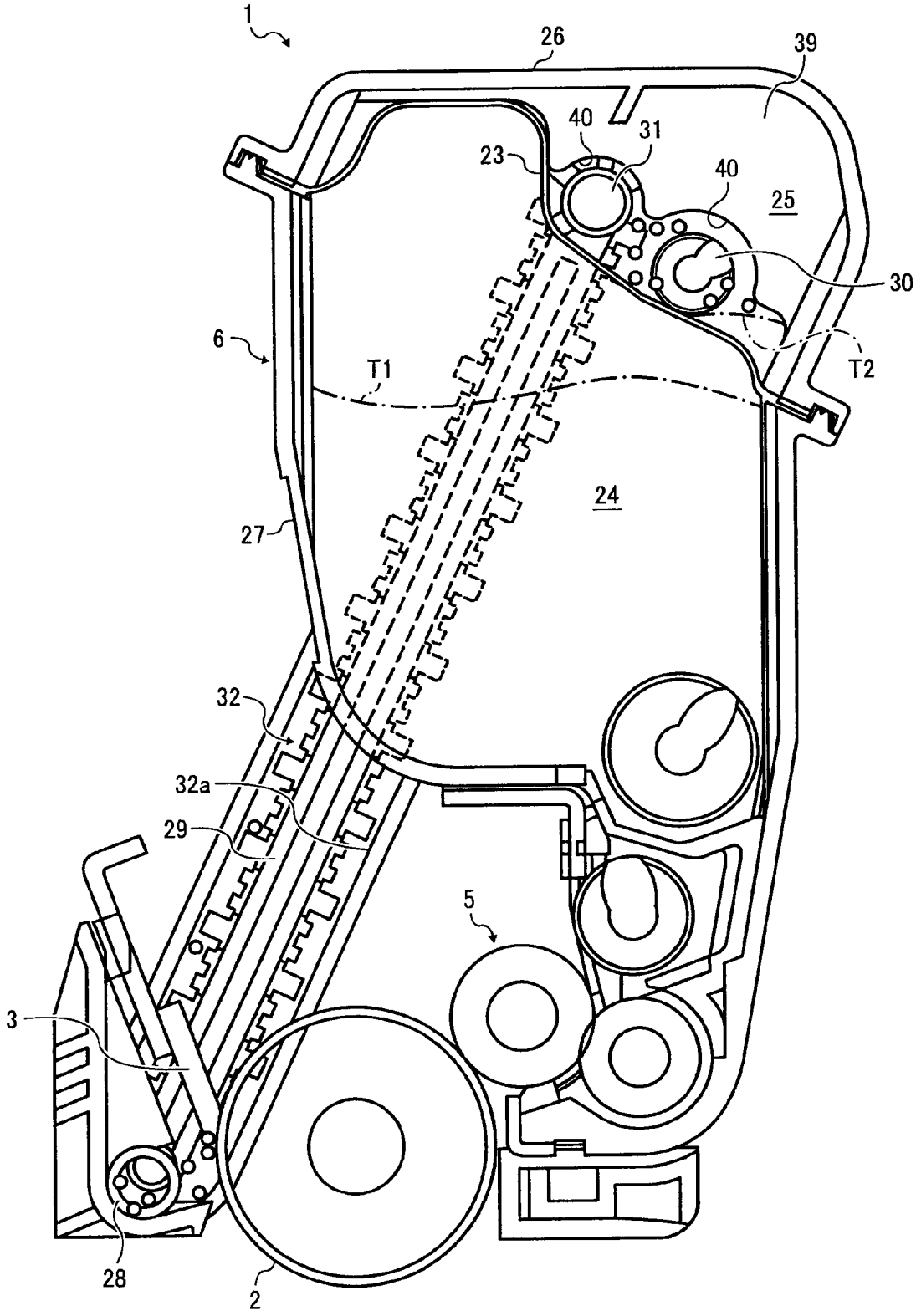
FIG. 3 is a cross section of the process unit taken from line X-X of FIG. 2.

FIG. 3 is a cross section of the process unit 1 taken from line X-X of FIG. 2. The toner-collecting unit 6 includes a first casing 26, a second casing 27, and a partition member 23 located between the first casing 26 and the second casing 27. In other words, the toner-collecting unit 6 includes two toner chambers 24 and 25 separated by the partition member 23. The first toner chamber 24 on the second casing 27 side contains unused toner T1 and the second toner chamber 25 on the first casing 26 side contains waste toner T2.

The partition member 23 is a flexible member made of a plastic sheet. The partition member 23 is movable to the first toner chamber 24 side and the second toner chamber 25 side. In other words, if the unused toner T1 inside the first toner chamber 24 reduces as the waste toner T2 is collected in the second toner chamber 25, the partition member 23 gradually falls down due to the weight of the collected waste toner T2.

The toner conveying unit includes a first conveying screw 28 on a lower side, a conveying belt 29, a second conveying screw 30, and a third conveying screw 31. The first conveying screw 28, which is a spiral coil, horizontally conveys waste toner removed by the cleaner 3. The conveying belt 29 conveys upward the waste toner transferred from the first conveying screw 28. The second conveying screw 30, which is a spiral shaft, horizontally carries the waste toner conveyed by the conveying belt 29 to the second toner chamber 25. The third conveying screw 31, which is the spiral shaft, stirs and conveys the waste toner inside the second toner chamber 25.

Figure 4:
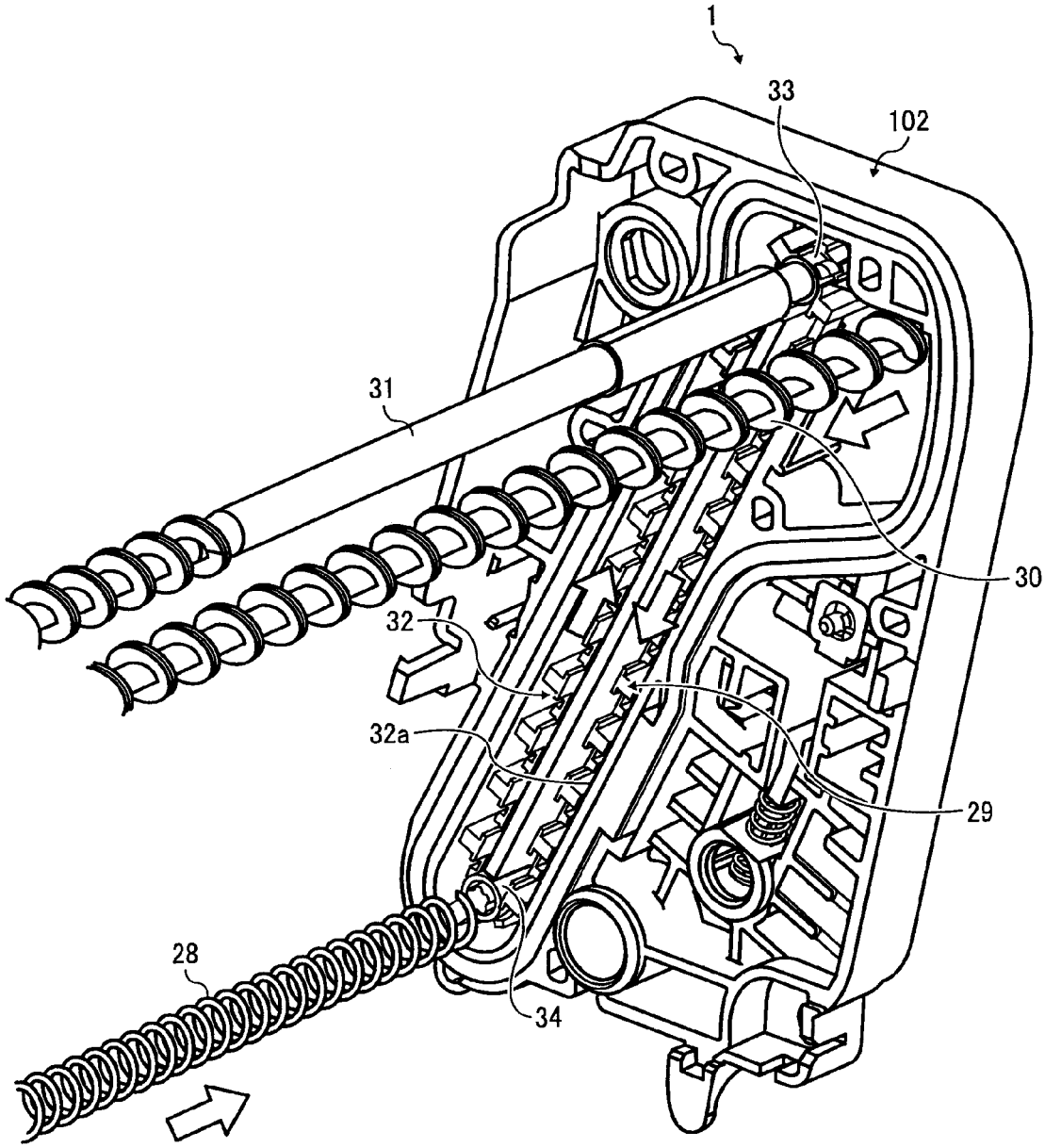
FIG. 4 is a perspective view of the inside of a first supporting member shown in FIG. 2.

FIG. 4 is a perspective view of the inside of the first supporting member 102. As shown in FIG. 4, a loop-like toner conveying path 32 is formed inside the first supporting member 102. The conveying belt 29 is an endless belt, and endlessly moves along the toner conveying path 32. A plurality of convexo-concave portions are formed on a conveying surface on the outer circumference of the conveying belt 29. Waste toner is conveyed while retained between the convexo-concave portions and a peripheral wall inner surface 32*a*, which forms the toner conveying path 32.

The conveying belt 29 is stretched over a power transmission shaft 33 on the upper side and a roller 34 on the lower side. The power transmission shaft 33 is rotatably arranged on the toner conveying path 32. Although the conveying belt 29 is stretched over the two shafts, the conveying belt 29 can also be stretched over three or more shafts. The power transmission shaft 33 is connected to one end of the third conveying screw 31. A drive gear (not shown) is connected to the other end of the third conveying screw 31. The drive gear is connected such that a rotary motion thereof is transmitted to the conveying belt 29 via the third conveying screw 31 and the power transmission shaft 33.

Explained below is the operation of the image forming apparatus. In FIG. 1, upon rotation of the feed roller 17 in response to a signal from a controller (not shown) of the image forming apparatus, the topmost sheet of the stack in the feed cassette 16 is picked up and fed to the registration rollers 18. If the leading edge of the sheet reaches a nip between the registration rollers 18, to be synchronized with a toner image formed on the intermediate transfer belt 12, the sheet awaits while sagging.

Image forming operations of the process unit 1K is explained below as an example. First, the charger 4 uniformly charges a surface of the image carrier 2 to high potential. Based on image data, the exposure device 7 irradiates a surface of the image carrier 2 with the laser beam L1. Accordingly, electric potential decreases in a portion irradiated with the laser beam L1, and thus an electrostatic latent image is formed on the surface of the image carrier 2. An unused black toner is supplied from the toner-collecting unit 6 (first toner chamber 24) to the developing unit 5. The developing unit 5 develops the electrostatic latent image on the surface of the image carrier 2 into a black toner image with the toner. The toner image formed on the surface of the image carrier 2 is then transferred onto the intermediate transfer belt 12. In the other process units 1C, 1M, and 1Y, as in the process unit 1K, a toner image is formed on the image carrier 2. Thus, the toner images of four colors are transferred onto the intermediate transfer belt 12 in a superimposed manner.

The registration rollers 18 and the feed roller 17 resume rotating and transfer a sheet to the secondary transfer roller 13 in synchronization with the superimposed toner images on the intermediate transfer belt 12. The secondary transfer roller 13 transfers the superimposed toner images onto the sheet as a color image.

The sheet with the color image thereon is conveyed to the fixing device 19. The sheet is then sandwiched between the fixing roller 19*a* and the pressure roller 19*b*, so that the color image is fixed on the sheet with heat and pressure. The sheet with the color image fixed thereon is transferred from the fixing device 19 to the eject rollers 20, and the sheet is ejected by the eject rollers 20 onto the stacking tray 21.

After the toner images on the intermediate transfer belt 12 are transferred onto the sheet, the belt cleaning device 14 removes from the intermediate transfer belt 12 residual toner remaining on the intermediate transfer belt 12. The residual toner removed from the intermediate transfer belt 12 is conveyed by a waste-toner conveying unit (not shown) and is collected in the waste-toner collecting device 22.

The cleaners 3 remove residual toner remaining on the surface of the image carrier 2 after the intermediate transfer process. A neutralization device (not shown) removes residual charge on the image carrier 2 after cleaning.

The first conveying screw 28 conveys the toner removed by the cleaners 3 to a lower end of the conveying belt 29, and the conveying belt 29 conveys the toner to the upper side. The waste toner falls at the upper end of the conveying belt 29, and the second conveying screw 30 carries the waste toner in the second toner chamber 25.

Although the spiral threads of the second conveying screw 30 and the third conveying screw 31 are formed in the same direction, the spiral threads are inversely rotating with respect to each other. In other words, the second conveying screw 30 conveys the waste toner to a back side (lower side in FIG. 5) of the second toner chamber 25 and the third conveying screw 31 conveys the waste toner, which is conveyed by the second conveying screw 30, to a front side (upper side in FIG. 5) of the second toner chamber 25. The waste toner is transported by the second conveying screw 30 and the third conveying screw 31 in the inverse direction. Thus, the waste toner is stirred and the deformable partition member 23 is effectively inflated to the lower side. Due to this, the waste toner can be collected.

Figure 5:
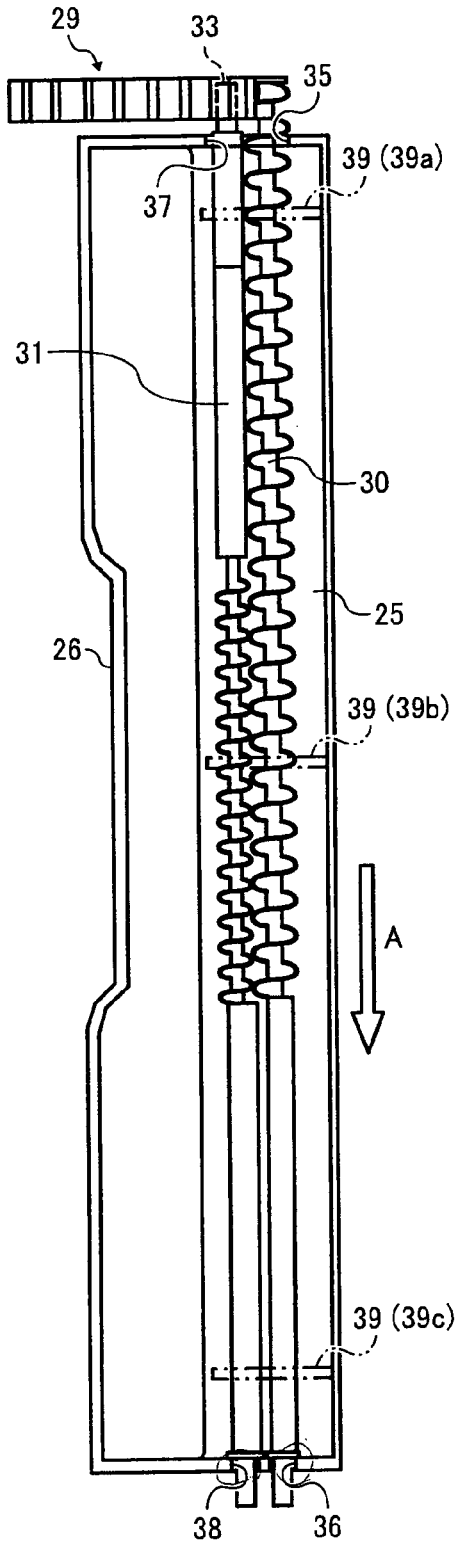
FIG. 5 is a schematic plan view of the process unit.

FIG. 5 is a schematic plan view of the process unit 1. An end portion of the second conveying screw 30 on an upper side in FIG. 5 protrudes from a through-hole 35, i.e., toner conveying port, that penetrates through a side surface of the first casing 26 on the upper side in FIG. 5. The other end portion of the second conveying screw 30 on a lower side in FIG. 5 protrudes from a through-hole 36 that penetrates through the other side surface of the first casing 26 on the lower side in FIG. 5. The lower end portion of the second conveying screw 30 is connected to the drive gear. The through-hole 35 is a toner conveying port for carrying waste toner conveyed by the conveying belt 29 to the second toner chamber 25.

End portions of the third conveying screw 31 protrude from a through-hole 37 on the upper side in FIG. 5 and a through-hole 38 on the lower side in FIG. 5. The through-holes 37 and 38 are arranged adjacent to the through-holes 35 and 36, respectively, and the second conveying screw 30 protrudes from the through-hole 36. As described above, the end portion of the third conveying screw 31 on the upper side in FIG. 5 is connected to the power transmission shaft 33 of the conveying belt 29 and the other end portion of the third conveying screw 31 on the lower side in FIG. 5 is connected to the drive gear.

In the embodiment, the second conveying screw 30 and the third conveying screw 31 can be respectively inserted from the through-holes 35 and 37 on the upper side to the through-holes 36 and 38 on the lower side in an insertion direction indicated by arrow A. The second conveying screw 30 and the third conveying screw 31 can also be inserted from a direction opposite to the insertion direction indicated by arrow A, or can be inserted from both the directions.

As shown in FIG. 5, three guide members 39 (39*a* to 39*c*) are arranged inside the second toner chamber 25. The guide members 39*a* to 39*c* are arranged in the middle and at both the ends in a shaft direction of the second conveying screw 30 (the third conveying screw 31) and extends in a direction perpendicular to the shaft direction.

Figure 6:
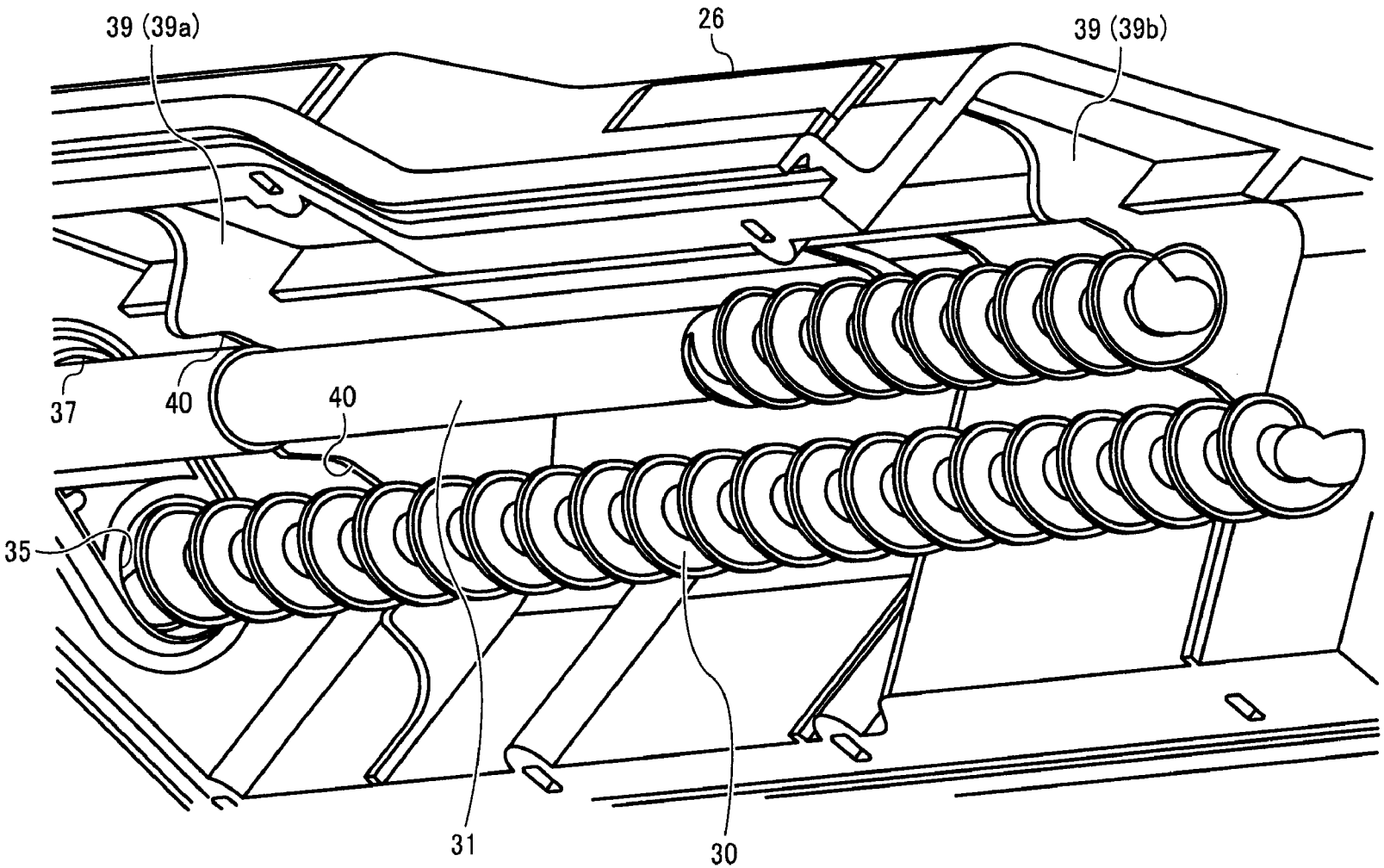
FIG. 6 is a perspective view of a first casing shown in FIG. 3.

FIG. 6 is a perspective view of the first casing 26 viewed from a lower side. As shown in FIG. 6, the guide member 39 is a plate-like member. The guide members 39*a* and 39*b* in FIG. 5 correspond to the guide member 39 in FIG. 6.

The guide member 39 is integrally fixed to an upper inner surface of the first casing 26. The second conveying screw 30 and the third conveying screw 31 are inserted between the guide member 39 and the partition member 23 (see FIG. 3). The edge of the guide member 39 facing the second conveying screw 30 and the third conveying screw 31 constitutes a sliding portion 40. The sliding portion 40 allows the second conveying screw 30 and the third conveying screw 31 to slide for inserting them in the first casing 26.

Figure 7:
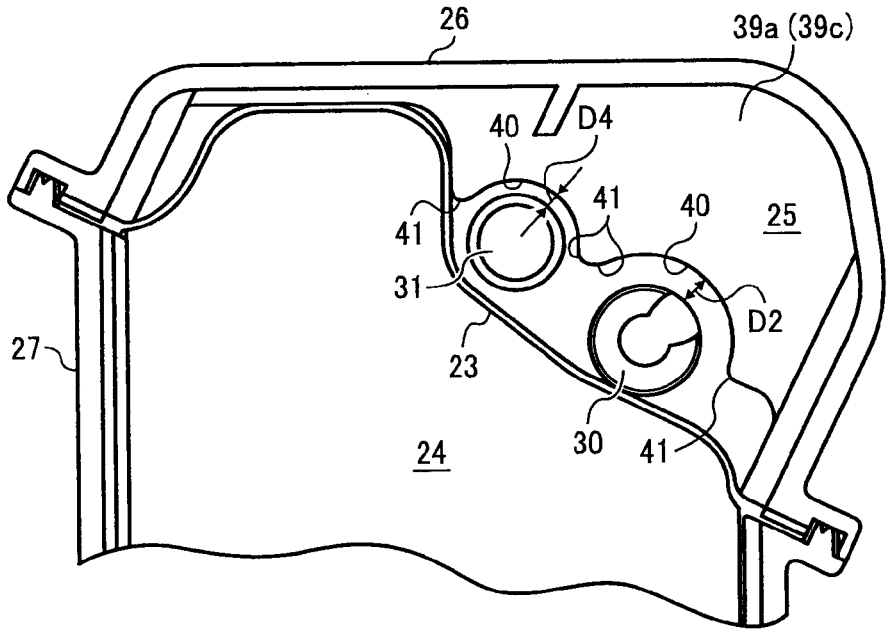
FIGS. 7 and 8 are schematic diagrams of relevant part of the process unit.

The three guide members 39 (39*a* to 39*c*) are of substantially similar shape. Thus, the guide member 39*a* is explained as an example for explaining the shape of each guide member 39. As shown in FIG. 7, the sliding portion 40 of the guide member 39*a* is formed in an arc concave shape or a semicircular arc concave shape that matches the outer circumference of the second conveying screw 30 and the third conveying screw 31. In addition to the arc shape and the semicircular arc shape, the sliding portion 40 can be formed in a rectangular concave shape or a V character shape.

A portion of the guide member 39*a* protruded on the second conveying screw 30 and the third conveying screw 31 side or a portion protruded on the partition member 23 side is formed in a convex type curve shape. To be specific, both end portions 41 of the sliding portion 40 are formed in the convex type curved shape.

If the guide member 39 interferes with the second conveying screw 30 and the third conveying screw 31 fitted in the first casing 26, there may be a reduction in a conveying capacity, noise, or damage to guide member 39. Thus, a spacing (D2 and D4 in FIG. 7) is maintained between the guide member 39 and the second conveying screw 30 and the third conveying screw 31 such that the guide member 39 does not interfere with the second conveying screw 30 and the third conveying screw 31.

The second conveying screw 30 and the third conveying screw 31 are made of resin material such as polystyrene (PS), acrylonitrile butadiene styrene (ABS), and polyoxymethylene (POM), and is not always highly rigid. Thus, waste toner collected in the second toner chamber 25 may bend the second conveying screw 30 and the third conveying screw 31 by pressing them. The second conveying screw 30 and the third conveying screw 31 can be formed bent. In the embodiment, both ends of the second conveying screw 30 and the third conveying screw 31 are supported. Thus, a deformation amount, if any, becomes maximum around the center of the second conveying screw 30 and the third conveying screw 31 in a direction perpendicular to the rotation center axis of the conveying screws 30 and 31 (hereinafter, "axial perpendicular direction").

Incidentally, the deformation amount in the axial perpendicular direction indicates, for example, an amount of deformation of the second conveying screw 30 or the third conveying screw 31 that has been accidentally bent and thus rotates while partially deformed in the axial perpendicular direction. The deformation amount also indicates an amount of deformation (eccentricity) of the second conveying screw 30 or the third conveying screw 31 that includes a portion or a member such as a crankshaft creating eccentric rotation.

Figure 8:
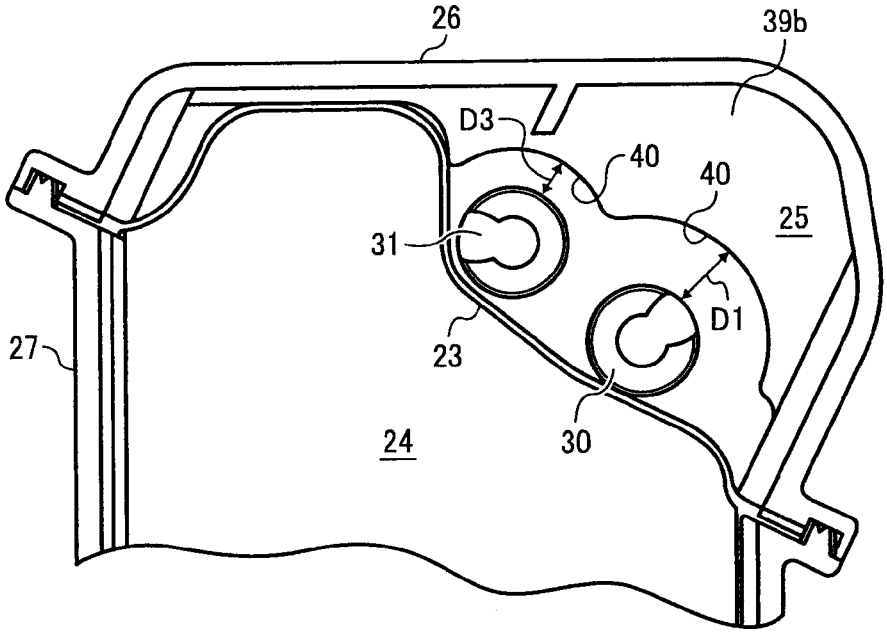

Spacing D1 (see FIG. 8) between the second conveying screw 30 and the guide member 39*b* in the middle in the shaft direction is greater than spacing D2 (see FIG. 7) between the second conveying screw 30 and the guide members 39*a* and 39*c* on both ends in the shaft direction. Similarly, with respect to the third conveying screw 31, spacing D3 (see FIG. 8) between the guide member 39*b* and the third conveying screw 31 is greater than spacing D4 (see FIG. 7) between the guide members 39*a* and 39*c* and the third conveying screw 31.

Thus, a spacing between a portion of the second conveying screw 30 or the third conveying screw 31 that is significantly bent and the guide member 39*b* corresponding to the portion is widely ensured. Thus, even if the second conveying screw 30 and the third conveying screw 31 bend, the spacing is set such that the second conveying screw 30, the third conveying screw 31, and the guide member 39*b* do not interfere with each other.

If the second conveying screw 30 or the third conveying screw 31 is supported at one end, the deformation amount in the axial perpendicular direction becomes maximum at the end portion that is not supported. Thus, it is desirable to relatively secure a wide spacing between the end portions of the second conveying screw 30 and the third conveying screw 31 that are not supported and the guide members 39 that are arranged in the vicinity of the end portions.

If the second conveying screw 30 and the third conveying screw 31, which are in straight status, are bent, by intentionally causing the second conveying screw 30, the third conveying screw 31, and the guide members 39 to interfere, the deformation in the axial perpendicular direction due to bending of the second conveying screw 30 and the third conveying screw 31 can be controlled not to exceed the allowable range. In other words, the guide members 39 are arranged within an allowable range of deformation in the axial perpendicular direction from the straight status of the second conveying screw 30 and the third conveying screw 31. The allowable range of deformation indicates a range in which the second conveying screw 30 and the third conveying screw 31 are not damaged even if they are bent to some extent and are deformed in the axial perpendicular direction, or a range in which the second conveying screw 30 and the third conveying screw 31 can perform the toner conveying function. The allowable range includes other ranges that are arbitrarily decided.

Figure 9C:
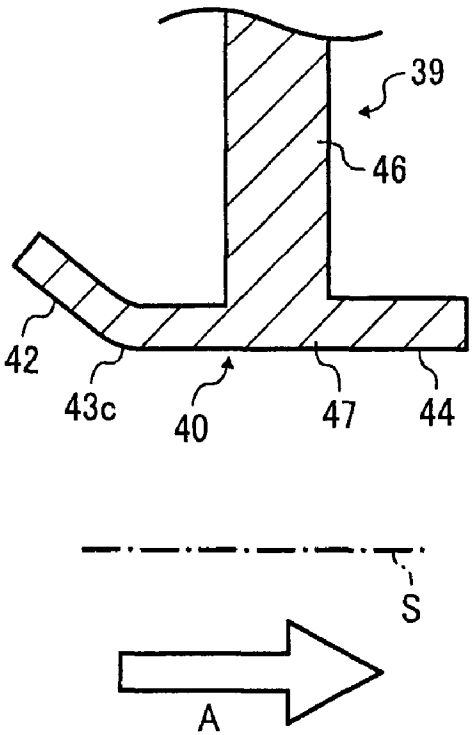
FIGS. 9A to 9C are enlarged views of relevant part of a guide member shown in FIG. 3 and modifications thereof.
Figure 9B:
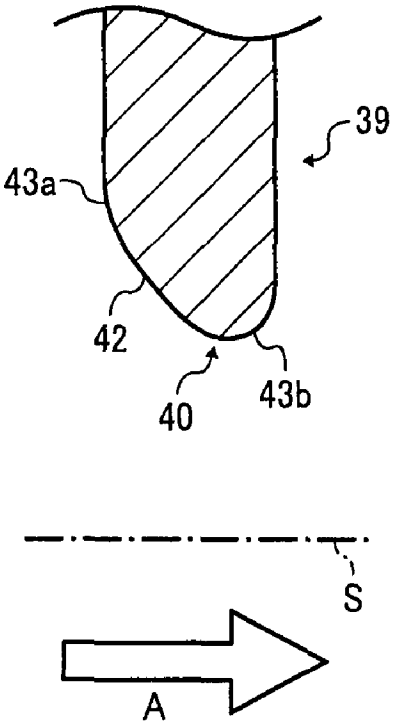
Figure 9A:
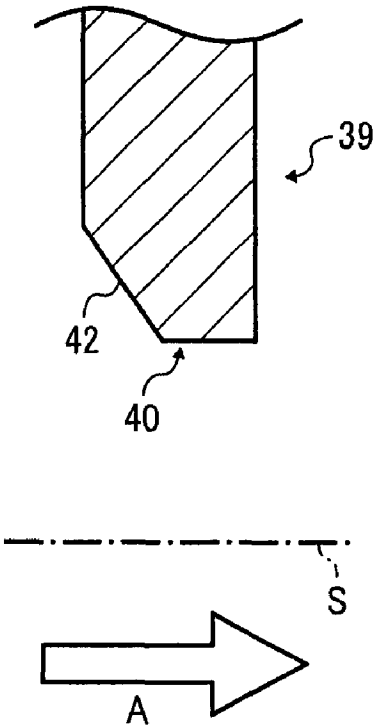

Modifications of the guide members 39 are explained below. FIGS. 9A to 9C are schematic diagrams of the guide members 39 and modifications thereof. In FIGS. 9A to 9C, the second conveying screw 30 or the third conveying screw 31 is inserted through an insertion path S into the toner-collecting unit 6 in the insertion direction A.

The guide member 39 shown in FIG. 9A has an inclined surface 42 formed on the sliding portion 40. Specifically, the inclined surface 42 inclines in the insertion direction A, i.e., the inclined surface 42 tapers toward the insertion path S. Instead of being tapered as shown in FIG. 9A, the inclined surface 42 can form a curve.

The guide member 39 shown in FIG. 9B has the inclined surface 42, which is similar to that of FIG. 9A, on the sliding portion 40, and curved portions 43*a* and 43*b* are provided to both ends of the inclined surface 42. In other words, in FIG. 9B, a sharp edge as shown in FIG. 9A is rendered smooth and curved.

The guide member 39 shown in FIG. 9C includes a base plate 46 that is vertically arranged in the second toner chamber 25, a slide plate 47 that is integrally fixed at the end of the base plate 46 and extends along the insertion path S. The sliding portion 40 is arranged on the lower surface of the slide plate 47. The sliding portion 40 includes the inclined surface 42 on an upstream side (left side in FIG. 9C) in the insertion direction A, a straight portion 44 on a downstream side (right side in FIG. 9C) in the insertion direction A, and a curved portion 43*c* that connects the inclined surface 42 and the straight portion 44. The inclined surface 42 is inclined similarly to that of FIG. 9A, and the straight portion 44 is arranged parallel to the insertion path S.

Figure 10:
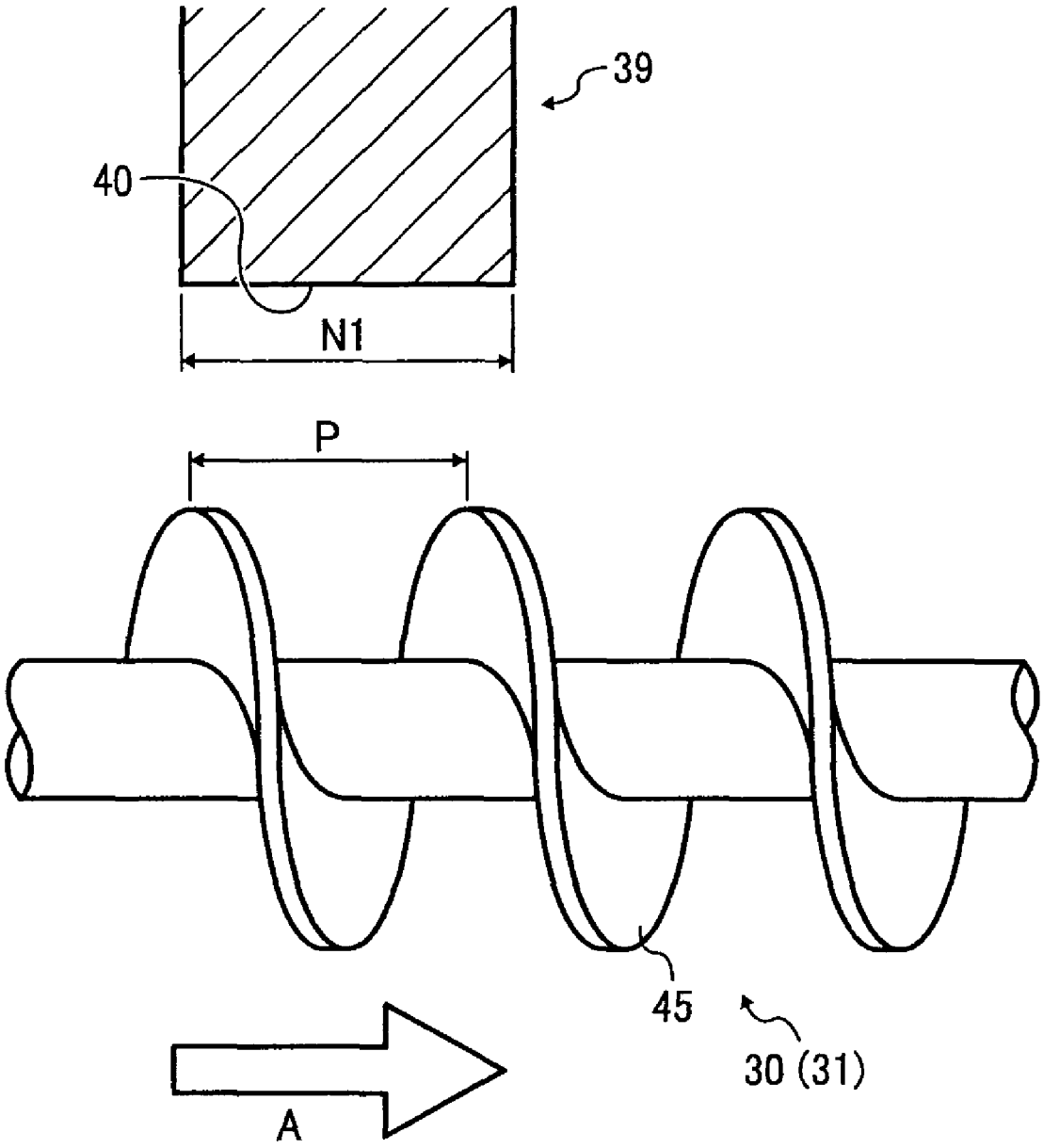
FIG. 10 is a schematic diagram for explaining a relation between a length of the guide member and a pitch width of spiral thread of a conveying screw shown in FIG. 3.

As shown in FIG. 10, it is desirable to set a length (width) N1 in the insertion direction A of the sliding portion 40 greater than a pitch width P of a spiral thread 45 of the second conveying screw 30 (the third conveying screw 31).

Thus, when the second conveying screw 30 (the third conveying screw 31) is caused to slide in the sliding portion 40 of the guide member 39, the guide member 39 does not enter the spiral thread 45 of the second conveying screw 30. Thus, the second conveying screw 30 can be smoothly guided. If the length N1 of the guide member 39 is set as large as shown in FIG. 10 and if the guide member 39 is a resinous type member, sink marks occur after formation of the guide member 39. For avoiding the sink marks in the guide member 39, the shape of the guide member 39 of FIG. 9C can be applied.

Figure 11A:
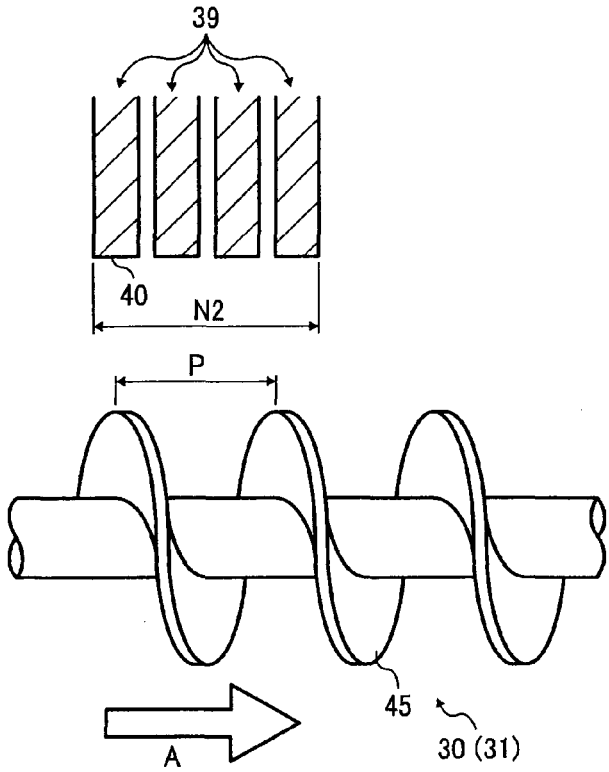
FIG. 11A is a schematic diagram for explaining a relation between a distance between opposite surfaces of guide members on both ends and the pitch width of the spiral thread of the conveying screw.
Figure 11B:
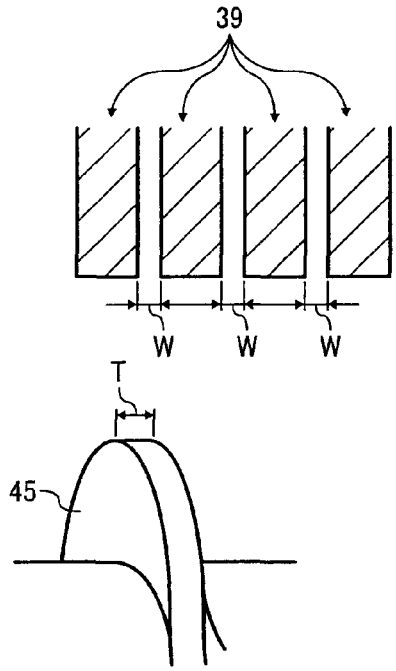
FIG. 11B is a schematic diagram for explaining a relation between a spacing between adjacent two of the guide members and a width of the spiral thread of the conveying screw.

As shown in FIG. 11A, for avoiding the sink marks, a plurality of guide members 39 can be arranged close to each other in a comb-like shape in the insertion direction A. Among the guide members 39, a length N2 between end surfaces, which are facing each other, of the guide members 39 arranged on both ends is set greater than the pitch shaft P of the spiral thread 45 of the second conveying screw 30 (the third conveying screw 31). Due to this, entering of the guide members 39 in the spiral thread 45 of the second conveying screw 30 (the third conveying screw 31) is prevented. As shown in FIG. 11B, it is desirable to set spacing W between adjacent two of the guide members 39 smaller than a thickness T of the spiral thread 45. Thus, because the spiral thread 45 does not enter between the plurality of guide members 39, the second conveying screw 30 (the third conveying screw 31) can be smoothly guided.

A method to fix the second conveying screw 30 and the third conveying screw 31 in the first casing 26 is explained below.

Figure 12:
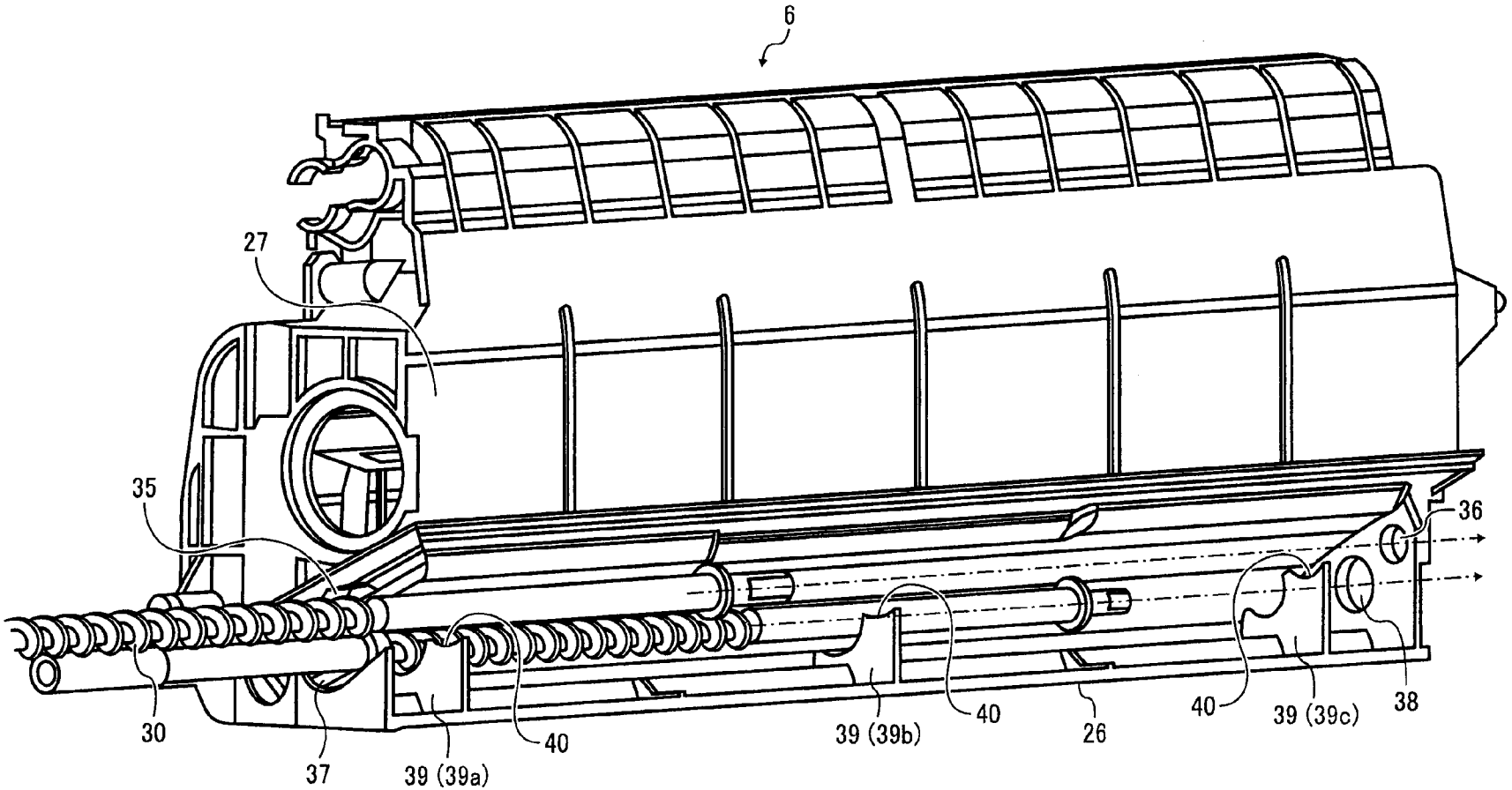
FIG. 12 is a schematic diagram for explaining a process of inserting the conveying screw in the first casing.

As shown in FIG. 3, the first casing 26 and the second casing 27 are ultrasonically welded to each other via the partition member 23, and the first casing 26 and the second casing 27 are integrated to form the toner-collecting unit 6. The upper surface of the first casing 26 is formed flat. The toner-collecting unit 6 is placed on, for example, a work table as shown in FIG. 12 such that the upper surface of the first casing 26 is positioned downward. When the toner-collecting unit 6 is set upside down, due to gravitational force, the partition member 23 is expanded downward and is deformed. Each guide member 39 supports the partition member 23 deformed downward. The edge of the guide member 39 protruding to the partition member 23 side is convexly curved as shown in FIG. 3. Thus, even if the partition member 23 contacts the convexly curved edge, the partition member 23 is less likely to be damaged.

As shown in FIG. 12, the second conveying screw 30 is inserted inside from the through-hole 35 of the first casing 26. A tip of the second conveying screw 30 is sequentially inserted from the front guide member 39*a*, the middle guide member 39*b*, and then the backside guide member 39*c*. The tip of the second conveying screw 30 is inserted such that the tip of the second conveying screw 30 is caused to slide in the sliding portion 40 of the guide member 39*a*, the guide member 39*b*, and the guide member 39*c*. The tip of the second conveying screw 30 when contacted with the sliding portion 40 of the backside guiding member 39*c* is positioned in the vicinity of the through-hole 36. The tip of the second conveying screw 30 is further forwarded and is protruded to the exterior from the through-hole 36.

The third conveying screw 31 can be inserted in the first casing 26 similarly as the second conveying screw 30 is inserted. Either of the second conveying screw 30 and the third conveying screw 31 can be inserted first.

As described above, if the toner-collecting unit 6 is inverted, the guide member 39 is positioned on the lower side of the insertion path S. In other words, the guide members 39 are positioned gravitationally downward from the second conveying screw 30 and the third conveying screw 31 in the inserted position. With this, an operator can easily bring the second conveying screw 30 and the third conveying screw 31 in contact with the guide member 39.

Even if the toner-collecting unit 6 is set upside down, it is possible to prevent a significant deformation of the partition member 23 on the insertion path S side, i.e., the lower side, because of the guide member 39. With this configuration, a contact resistance at the time of insertion between the second conveying screw 30, the third conveying screw 31, and the partition member 23 can be reduced. Furthermore, by reducing the contact resistance at the time insertion between the second conveying screw 30, the third conveying screw 31, and the partition member 23, a likelihood of damage to the partition member 23 is reduced.

In other words, even if the partition member 23 is formed in a sack shape that can be significantly deformed on the first toner chamber 24 side and the second toner chamber 25 side, deformation of the partition member 23 on the second toner chamber 25 side can be prevented because of the guide member 39. However, after the toner is used, by significantly deforming the partition member 23 on the first toner chamber 24 side, a capacity of the second toner chamber 25 can be widely ensured.

For preventing the significant deformation of the partition member 23 on the insertion path S side, for example, a beam-like guide member 39 can be arranged between the partition member 23 and the insertion path S. However, for widely securing the capacity of the first toner chamber 24, it is desirable to arrange the guide member 39 as shown in FIG. 3 on an opposite side of the partition member 23 by sandwiching the insertion path S therebetween.

If the sliding portion 40 of the guide member 39 is formed in a deep concave shape, even if the partition member 23 is deformed on the insertion path S side, the spacing is easily ensured between the sliding portion 40 of the guide member 39 and the partition member 23. The second conveying screw 30 and the third conveying screw 31 pass through the spacing. Due to this, the second conveying screw 30 and the third conveying screw 31 can be easily inserted in a single layer and a likelihood of damage to the partition member 23 is reduced.

Figure 13:
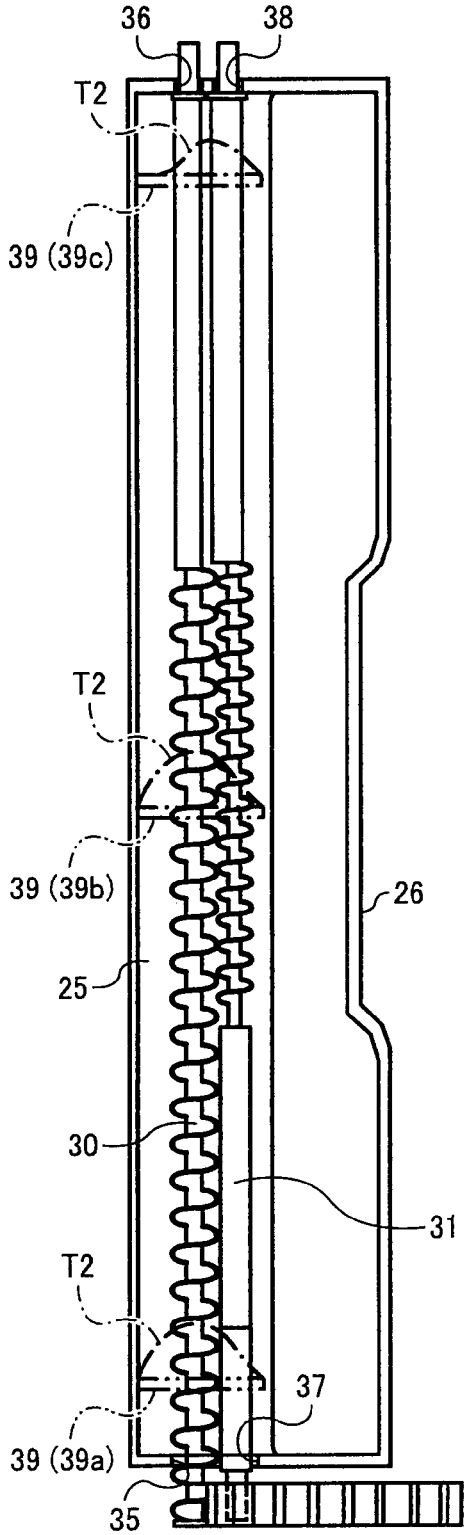
FIG. 13 is a schematic plan view of the process unit with a toner conveying port set gravitationally downward.

As shown in FIG. 13, if the process unit 1 is accidentally inclined and the through-hole 35 is arranged in the gravitationally downward direction, the waste toner inside the second toner chamber 25 moves downward due to gravitational force. Thus, the waste toner T2 is received by the guide member 39 and moving of the waste toner T2 to the through-hole 35 is prevented. Due to this, moving of the entire waste toner to the through-hole 35 can be prevented and blocking of the through-hole 35 by the waste toner can be controlled. By increasing positions for arranging the guide members 39 to more than or equal to four and increasing an area of the guide members 39, toner receiving effect of the guide member 39 can be increased.

Although by way of example and not limitation, in the above embodiment, the process unit 1 includes the image carrier 2, the cleaner 3, the charger 4, the developing unit 5 and the toner-collecting unit 6, the toner-collecting unit 6 can be arranged in a toner-collecting device that is detachably attached to an image forming apparatus. That is, the toner-collecting unit 6 can be arranged independently of the image carrier 2, the cleaner 3, the charger 4, and the developing unit 5. The toner-collecting unit 6 can also be arranged in the toner-collecting device as being integrated with the image carrier 2 or the image carrier 2 and any one of the cleaner 3, the charger 4, and the developing unit 5. The toner-collecting device can include other members than them. The guide members 39 need not be of plate-like shape as illustrated. Although a plurality of guide members are shown in the drawings, it is understood that only one can be provided if so desired. Besides, shaft members, without limiting to the conveying screws, such as a driving shaft can be inserted into the toner-collecting unit 6.

As set forth hereinabove, according to an embodiment of the present invention, guide members can smoothly guide shaft members from one end of a toner-collecting unit to the other end. This facilitates insertion of the shaft members in the toner-collecting unit. Thus, it is possible to increase efficiency in assembly work for the shaft members and to reduce manufacturing cost.

Moreover, a contactable range of a sliding portion with the shaft members increases, and the shaft members are less likely to separate from the sliding portion. Thus, the shaft members can be stably guided. Even if the shaft members contact both ends of the sliding portion, the shaft members can slide smoothly.

Furthermore, the shaft members and the guide members can be adjusted to prevent the shaft members from deforming beyond the allowable range. The guide members can receive toner to be transported to a toner conveying port in the toner-collecting unit. Thus, the toner conveying port can be prevented from being blocked by the toner. The guide members are located on the insertion-path side and prevent a partition member from being deformed to the insertion-path side. Thus, contact resistance between the shaft members being inserted and the partition member can be reduced. This results in less damage to the partition member.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A toner-collecting device comprising:

a toner-collecting unit that is configured to be detachably attachable;

a shaft member that is rotatably arranged in the toner-collecting unit; and a guide member that includes a sliding portion that allows the shaft member to slide across while the shaft member is being inserted in an insertion direction from one end to an opposite end of the toner-collecting unit through an insertion path, the guide member projecting from an inner surface of the toner-collecting unit and enclosed within the toner-collecting unit, the guide member including a plurality of guide members that are arranged in parallel, each guide member projecting from the inner surface of the toner collecting unit in a direction perpendicular to the insertion direction.

2. The toner-collecting device according to claim 1, wherein the sliding portion extends in a direction parallel to the insertion direction.

3. The toner-collecting device according to claim 1, wherein the sliding portion is in a concave shape corresponding to an outer circumference of the shaft member.

4. The toner-collecting device according to claim 3, wherein both ends of the sliding portion are convexly curved.

5. The toner-collecting device according to claim 1, wherein the sliding portion includes an inclined surface that inclines in the insertion direction such that the sliding portion is tapered toward the insertion path.

6. The toner-collecting device according to claim 1, wherein the sliding portion includes a curved portion in a cross section in the insertion direction.

7. The toner-collecting device according to claim 1, wherein a spacing between the shaft member and the guide member is defined based on an amount of deformation of the shaft member in a direction perpendicular to a rotation center axis of the shaft member.

8. The toner-collecting device according to claim 1, wherein the guide member is arranged in an allowable range of deformation of the shaft member that partially deforms from a straight posture in a direction perpendicular to a rotation center axis of the shaft member.

9. The toner-collecting device according to claim 1, wherein the guide member is arranged below the insertion path.

10. The toner-collecting device according to claim 1, wherein the toner-collecting unit includes a toner port, and the guide member is in a plate shape that is perpendicular to the insertion direction.

11. The toner-collecting device according to claim 10, wherein the guide member is located near the toner port.

12. The toner-collecting device according to claim 1, wherein the toner-collecting unit includes a partition member that is flexible and located on a first side of the insertion path, and the guide member is located on a second side of the insertion path opposite to the first side.

13. The toner-collecting device according to claim 1, wherein the shaft member is a screw having a spiral thread, and the sliding portion is longer in the insertion direction than a pitch of the spiral thread.

14. The toner-collecting device according to claim 13, wherein the plurality of guide members each have a first surface and a second surface opposite to the first surface, and are arranged close to each other in the insertion direction, the guide members including a first endmost guide member and a second endmost guide member at both ends of the guide members, a distance between the first surface of the first endmost guide member and the second surface of the second endmost guide member is greater than a width of the pitch of the spiral thread.

15. The toner-collecting device according to claim 14, wherein a spacing between adjacent two of the guide members is smaller than a thickness of the spiral thread.

16. The toner-collecting device according to claim 1, wherein the toner-collecting unit is integrated with an image carrier.

17. The toner-collecting device according to claim 1, wherein the toner-collecting unit integrated with an image carrier is integrated with any one of a charging unit, a developing unit, and a cleaning unit.

18. An image forming apparatus comprising:

a toner-collecting device including a toner-collecting unit that is configured to be detachably attached to the image forming apparatus;

a shaft member that is rotatably arranged in the toner-collecting unit; and a guide member that includes a sliding portion that allows the shaft member to slide across while the shaft member is being inserted from one end to an opposite end of the toner-collecting unit, the guide member projecting from an inner surface of the toner-collecting unit and enclosed within the toner-collecting unit, the guide member including a plurality of guide members that are arranged in parallel, each guide member projecting from the inner surface of the toner collecting unit in a direction perpendicular to the insertion direction.

* * * * *